United States Patent [19]

Foster

[11] Patent Number: 4,684,044

[45] Date of Patent: Aug. 4, 1987

[54] VISCOUS PRODUCT DISPENSER HAVING EXTERNALLY LOCATED, DISPENSED PRODUCT SHEARING OUTLET VALVE PROVIDED WITH LOST-MOTION ACTION

[75] Inventor: Donald D. Foster, Kingsville, Mo.

[73] Assignee: Realex Corporation, Kansas City, Mo.

[21] Appl. No.: 876,647

[22] Filed: Jun. 17, 1986

Related U.S. Application Data

[63] Continuation of Ser. No. 589,640, Mar. 14, 1984, abandoned.

[51] Int. Cl.[4] ..... B67D 5/42

[52] U.S. Cl. ..... 222/386; 222/400.5; 222/560

[58] Field of Search ..... 222/409, 401, 402, 389, 222/387, 391, 400.5, 386, 386.5, 511, 517, 544, 560, 259, 556

[56] References Cited

U.S. PATENT DOCUMENTS

| | | | |
|---|---|---|---|
| 2,274,849 | 3/1942 | Peterson | 222/560 |
| 3,257,037 | 6/1966 | Watson, Jr. | 222/517 |
| 3,268,123 | 8/1966 | Spatz | 222/400.5 |
| 3,963,147 | 6/1976 | Waters | 222/560 |

FOREIGN PATENT DOCUMENTS

| | | | |
|---|---|---|---|
| 3104726 | 8/1982 | Fed. Rep. of Germany | 222/386 |
| 0084638 | 8/1982 | Fed. Rep. of Germany | 222/391 |

*Primary Examiner*—Joseph J. Rolla
*Assistant Examiner*—Kenneth Noland
*Attorney, Agent, or Firm*—Schmidt, Johnson, Hovey & Williams

[57] ABSTRACT

The actuating lever of the dispenser has an outlet valve flap integral therewith which moves in a shearing action across the outlet of the discharge spout as the actuator is returned to its standby position such that the returning valve flap cleanly slices through the bead of viscous product adhering to the spout and this fully separates the dispensed bead of product from that remaining behind in the spout. A lost-motion action permits the valve flap to uncover the spout outlet before further depression of the actuating lever shifts the pumping piston through its dispensing stroke to force product out the spout.

7 Claims, 3 Drawing Figures

VISCOUS PRODUCT DISPENSER HAVING EXTERNALLY LOCATED, DISPENSED PRODUCT SHEARING OUTLET VALVE PROVIDED WITH LOST-MOTION ACTION

This is a continuation of application Ser. No. 06/589,640, filed 3/14/84, now abandoned.

TECHNICAL FIELD

This invention relates to the field of manually-operated pumping dispensers having particular utility for viscous products such as toothpaste and the like.

BACKGROUND

In co-pending application Ser. No. 06/565,540, filed Dec. 27, 1983, and assigned to the assignee herein, a viscous product dispenser is disclosed showing an actuating lever provided with an intergral, external valve that opens and closes the discharge outlet of the spout. That arrangement has proved to be very attractive in many respects, particularly where the function of a checking outlet valve is desired that will not interfere with or disrupt the laminar flow of product from the dispenser during the pumping stroke, e.g., where the product being dispensed comprises toothpaste having layers of striping substance carefully laminated therein and whose integrity must be maintained for aesthetic reasons in the bead of product which is dispensed from the unit.

It has been found, however, that the "trapdoor-like" movement of the prior valve during closing tends to cause a quantity of the product to be pressed against the spout and create an unsightly residue. This also tends to cause the dispensed product bead to adhere to the valve and not fully separate from the product remaining within the spout. Additionally, it has been found that in some cases product is attempted to be pumped out of the spout by the moving pumping piston before such time as the valve flap has adequately uncovered the outlet.

SUMMARY OF THE PRESENT INVENTION

Accordingly, an important object of the present invention is to improve upon the outlet valve and actuator construction disclosed in said prior application in such a way that the benefits of such prior construction are retained, yet the problems associated with improper cut off of the dispensed product and unsightliness at the discharge spout are eliminated, as well as premature pumping action.

Pursuant to the foregoing, the present invention contemplates constructing and arranging the valve flap and extremity of the spout such that the flap moves across the outlet in a guillotine-like shearing action as the flap returns to its closed position. In this respect the valve flap moves through an arcuate path of travel having an axis which coincides with the axis of the arcuate surface at the extremity of the spout, such that the valve flap can move in close, contiguous relationship with the end of the spout during its return movement to cleanly sever the dangling product bead from the spout without in any way striking the spout or otherwise being impeded in its freedom of movement in this respect. Furthermore, the combination actuator and outlet valve unit is mounted on the discharge spout in such a way that the unit has an initial degree of lost motion, sufficient to at least substantially uncover the spout outlet, before such time as further continued depression of the actuator portion of the unit causes the pumping piston to commence its movement through a pumping stroke. Consequently, the valve flap is well removed from the spout outlet as the product begins to emanate from the outlet under the influence of the pumping piston.

DETAILED DESCRIPTION

Figure 1:
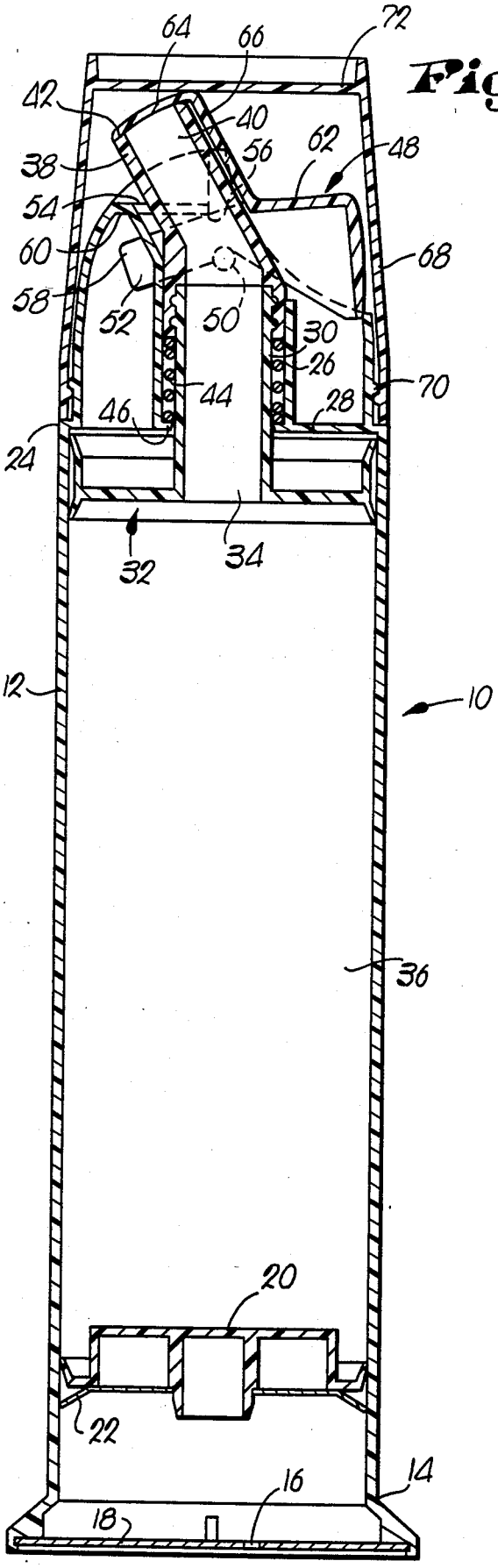
FIG. 1 is a vertical cross-sectional view of a dispenser constructed in accordance with the principles of the present invention and showing the actuator thereof in its undepressed, standby position with the spout outlet fully closed by the valve flap portion of the actuator.

The dispenser 10 includes a tubular, cylindrical body 12 which is open at its lower end 14 to the atmosphere via an aperture 16 in a decorative closure panel 18 or the like which spans the lower end 14. A floating piston 20 makes sealing engagement with the interior wall surface of the body 12 and has a downwardly and outwardly flaring metal skirt 22 or the like on the bottom thereof which likewise engages the interior surface of body 12. The skirt 22 is sufficiently resilient that it will deflect downwardly to any extent necessary to permit the piston 20 to rise in the body 12 yet is at the same time sufficiently stiff as to bite into the wall surface during attempted, downward movement of the piston 20 within body 12, thereby preventing such retrograde movement.

The opposite end 24 of the body 12 includes an upright, centrally disposed sleeve 26 supported by transversely extending web means 28. The sleeve 26 reciprocably receives the tubular stem 30 of a pumping piston 32 which at its circumferential periphery sealingly engages the inner wall surface of the body 12. A passage 34 is defined within the tubular stem 30, and the two pistons 20 and 32 cooperate with the body 12 to form a pumping chamber 36 therebetween.

The sleeve 26 also partially receives the lower end of a tubular discharge spout 38 which itself receives the upper end of the plunger stem 30 and is securely attached thereto. A passage 40 is defined within the spout 38, and a discharge outlet 42 is presented at the uppermost end thereof. A coil spring 44 encircles the piston stem 30 and is trapped between the lower extremity of the spout 38 and a lower, in-turned terminus 46 of the sleeve 26 for the purpose of yieldably biasing the piston 32 and the spout 38 toward an upper, undepressed position as illustrated in FIG. 1.

The dispenser 10 is also provided with an actuator unit broadly denoted by the numeral 48 pivotally mounted on a fulcrum 50 on the spout 38. The fulcrum 50 takes the form of a pair of pins projecting laterally from opposite sides of the spout 38, and a pair of legs 52 of the actuator unit 48 (only one leg 52 being illustrated) straddle the spout 38 and rest at their midpoints upon the respective fulcrum pins 50.

The legs 52 project forwardly at such an angle and to such an extent that they underlie respective ledges 54 on the body 12 adjacent the spout 38. Each of such ledges 54 has a first bottom surface 56 at the outermost extremity thereof which abuttingly engages the opposite side of the proximal leg 52 from the corresponding fulcrum pin 50 when the actuator 48 is in the standby position of FIG. 1, thus cooperating with the fulcrum pins 50 to trap the leg 52 therebetween. Spring pressure from the spring 44 assists in this regard, and the geometry is such that the actuator 48 tends to remain up in its FIG. 1 position with the legs 52 projecting downwardly and forwardly so that their outermost ends 58 are spaced below a second bottom surface 60 on each of the ledges 54 spaced inwardly from the terminal edge surface 56 thereof.

The actuator 48 includes a finger-engaging portion 62 on one side of the fulcrum pins 50 and a valve flap portion 64 on the opposite side thereof. The flap portion 64 is integrally joined with the finger-engaging portion 62 by an intermediate web portion 66, the valve flap portion 64 being of such dimension as to completely cover and thus close the outlet 42 when the actuator 48 is in its FIG. 1 position.

The outermost surface extremity of the spout 38 at the outlet 42 is transversely arcuate, having a center or axis coinciding with the fulcrum pins 50. Likewise, the valve flap 64 itself, particularly the underside thereof, is transversely arcuate in complemental relationship with the arcuate surface of the outlet 42. Thus, the exposed surface of the outlet 42, the undersurface of the valve flap 64, and the axis of pivoting movement of the actuator unit 48 all have centers or axes which coincide with one another at the fulcrum pins 50. Preferably, the valve flap 64 is so positioned that its undersurface lightly contacts the outwardly facing surface of the outlet 42 when the actuator 48 is in its FIG. 1 position.

If desired, the dispenser 10 may be provided with an overcap 68 which snaps down on to the body 12 via interfitting snap beads 70 at the base of the overcap 68. A transverse top wall 72 of the overcap 68 may be disposed to abuttingly engage the upper rear extremity of the valve flap 64 when the latter is in a position fully closing the outlet 42 as illustrated in FIG. 1 for the purpose of supplementing the force of the spring 44 tending to keep the valve flap 64 in a closed position.

OPERATION

Figure 2:
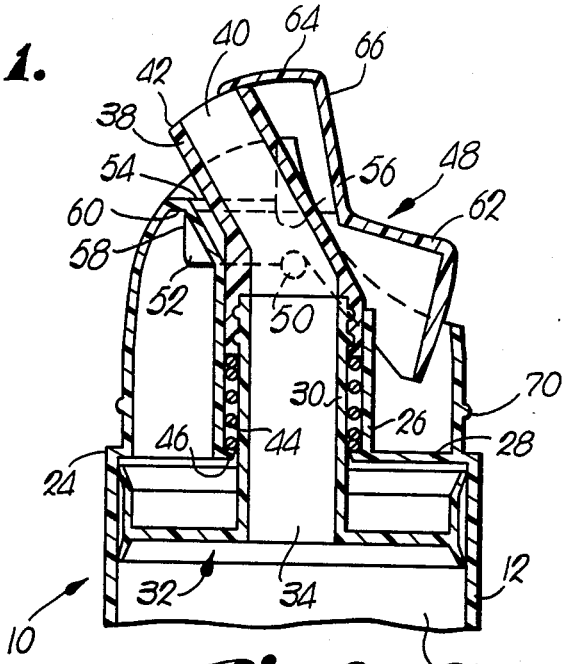
FIG. 2 is a fragmentary vertical cross-sectional view of the dispenser as in FIG. 1 but showing the actuator at the completion of its initial lost-motion travel during which time the valve flap portion of the actuator has uncovered the spout outlet but depression of the pumping piston has not yet commenced.

The return spring 44 normally maintains the pumping piston 32, the spout 38, and the actuator unit 48 in the position of FIG. 1 in which the valve flap 64 tightly covers, clsoes off, and thus seals the outlet 42. After removal of the overcap 68, application of downwardly directed finger pressure to the finger-engaging portion 62 of the actuator 48 will cause the latter to rock downwardly about the fulcrum pins 50 in a clockwise direction, sliding the valve flap 64 off the outlet 42 in the same direction until the condition as illustrated in FIG. 2 is reached. During such initial lost-motion movement, the upper edge surfaces 56 of the ledge 54 remain in engagement with the corresponding legs 58, and the point of contact of the legs 58 with such surfaces 56 is moved slightly along the legs 52 toward the outer ends 58 thereof. There is also a very slight, miniscule amount of downward movement of the spout 38 during this timeframe since the distance between the fulcrum pins 50 and the surfaces 56 of ledges 54 is increased slightly at this time to permit the outermost ends of the legs 52 to swing upwardly into abutting engagement with the second surfaces 60 of the ledges 54.

As it will be clearly seen in FIG. 2, by the time the outer ends 58 of the legs 52 have swung up to and engaged the second surfaces 60, the outlet 42 is substantially entirely opened by the valve flap 64. Yet, no substantial pumping motion of the pumping piston 32 has occurred.

Figure 3:
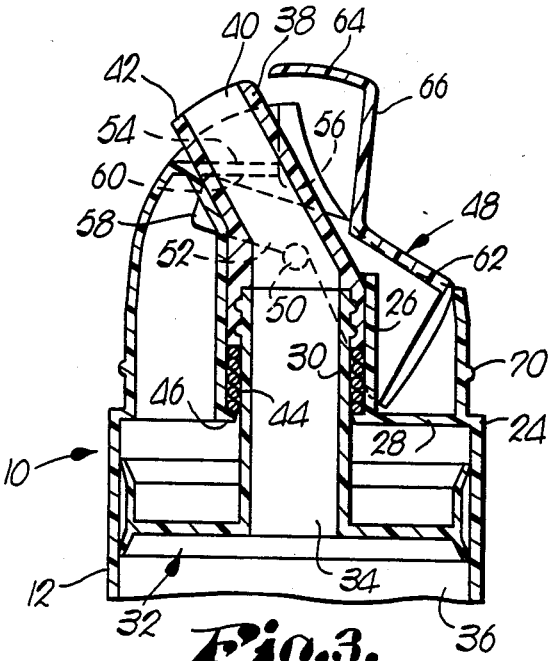
FIG. 3 is a fragmentary vertical cross-sectional view of the dispenser similar to FIG. 2 but showing the actuator operated to its fullest extent wherein the pumping piston is fully depressed.

As depression of the finger-engaging portion 62 then continues, the outer ends 58 of the legs 52 fulcrum against the surfaces 60 as the actuator unit 48 changes its fulcrum point from the pins 50 to the points of engagement of the legs 52 with surfaces 60 of ledges 54. During such time the pumping piston 32 becomes depressed and the legs 52 move away from the first surfaces 56 until the condition of FIG. 3 is reached, at which time a full pumping stroke has been completed in one direction.

Thereafter, releasing finger pressure on the portion 62 allows the spring 44 to raise the pumping piston 32 and the spout 38 back toward the FIG. 1 position thereof, while at the same time rotating the actuator 48 in a counterclockwise direction. By the time the actuator 48 reaches the position illustrated in FIG. 2, the valve flap 64 will just begin to slide back over the outlet 42. At this time there will be a sufficient amount of spring movement left in the spring 44 to continue to urge the actuator 48 counterclockwise in a lost-motion action as the piston 32 substantially comes to a halt.

As the valve flap 64 then slides downwardly across the open end of the outlet 42, it slices through the bead of product extending from the spout 34 and severs the same in the nature of a guillotine from the product left behind. By the time valve flap 64 is fully returned into covering relationship with the outlet 42, the bead of product has been completely disconnected from that remaining within the spout 38 in a neat, clean, and visually pleasing manner, leaving no clinging unsightly residue of any consequence in and around the outlet 42.

In view of the evacuation of product within the chamber 36 and the closing of the outlet 42 by valve flap 64, the floating piston 20 is moved upwardly within the chamber 36 by a corresponding amount as atmospheric pressure is applied against the bottom of the piston 20 via the aperture 16 in the aesthetic end cover 18. In this respect, it will be appreciated that, depending on the nature of the product being dispensed, the valve flap 64 serves in the capacity of a check valve to prevent significant retrograde movement of product back through the spout 38 in an effort to replenish that portion of the chamber 36 which has been evacuated during the immediately preceding pumping stroke. Consequently, the piston 20 is enabled to float upwardly within the chamber 36 in the proper manner to decrease the effective volume of the chamber 36 by the amount of discharged product.

It will be appreciated that only a single embodiment of the present invention has been disclosed herein. However, various obvious modifications to the disclosed embodiment will be apparent to those skilled in the art without departing from the spirit and underlying principles of this invention. Thus, the scope of the present invention should be deemed to include any such obvious modifications as may from time to time be made by those skilled in the art.

I claim:

1. In a dispenser for viscous products having an outlet in the outwardly facing end surface of a product discharge spout controlled by an external valve which opens and closes the outlet, said valve being disposed at one end of and movable with an actuating lever which is coupled with means for forcibly discharging product out of the spout when the lever is depressed, the improvement comprising:

means mounting the valve for transverse shearing movement of the latter entirely across the outlet and into closed, covering relationship with said end surface of the spout during return of the valve with the lever at the conclusion of product discharge whereby to promote severance of a dispensed bead of product from that remaining in the spout, said dispenser having its surface portion most adjacent the spout outlet spaced away from the outlet and from the valve to prevent contact between the valve and said surface portions during movement of the valve toward and away from its closed position, said actuating lever being coupled with said discharging means in such a way that said valve is at least substantially uncovered from the outlet by the actuating lever before product is attempted to be discharged by said discharging means.

2. In a dispenser as claimed in claim 1, wherein said valve has a leading, product-severing edge retracted out of engagement with and completely uncovering the end surface of the spout when the actuating lever is fully depressed.

3. In a dispenser for viscous products having an outlet at the end of a product discharge passage and controlled by an external valve which opens and closes the outlet, the improvement comprising:

means mounting the valve for transverse shearing movement of the latter across the outlet during return of the valve to a position closong said outlet whereby to promote severance of a dispensed bead of product from that remaining in the discharge passage, said valve being coupled with a manually engageable actuator for operating the valve, said actuator being coupled with means for discharging product from said outlet when the actuator is operated, said actuator being coupled with said discharging means in such a way that said valve is at least substantially uncovered from the outlet by the actuator before product is attempted to be discharged by said discharging means, said valve and said actuator comprising integrally molded portions of a common unit having leg means projecting therefrom, said discharging means being movable by the actuator and including a fulcrum pin means engaged by said leg means intermediate the opposite ends thereof, said dispenser having a first stationary surface in spaced opposition to said fulcrum pin means and cooperating with the latter in pivotally capturing said leg means therebetween during initial lost-motion movement of the actuator to open said valve, said dispenser further having a second surface spaced from said fulcrum pin means and disposed for fulcruming engagement with the outer end of said leg means during continued movement of the actuator following said lost-motion opening of the valve as the leg means is rocked away from said first surface.

4. A dispenser for viscous products comprising:

a generally tubular body provided with a discharge spout at one end thereof;

a pumping piston disposed within the body and secured to said spout for reciprocal movement of the spout and the piston together relative to the body during pumping strokes, said piston being tubular and cooperating with the spout to define a discharge passage for product from the interior of the body;

a take-up piston initially disposed at the opposite end of the body and movable within the latter only in a direction toward the pumping piston for progressively advancing the mass of product within the body toward the pumping piston following each discharge of product;

a combination actuator and outlet valve unit pivotally mounted on said spout externally of the latter, said unit being initially pivotal by the manual movement of an actuator portion thereof through a lost-motion segment of travel from a first position in which a valve portion of the unit closes the outlet of the spout to a second position in which said valve portion at least substantially uncovers the outlet without significant operation of said pumping piston, and thence being further pivotal by said actuator portion to a third position by which the pumping piston is operated to force product from the body; and means operably associated with said unit for yieldably biasing the same toward said first position and said pumping piston to an unoperated dispostion.

5. A dispenser as claimed in claim 4, wherein said valve portion of the unit is disposed for shearing movement across said outlet during lost-motion return of the unit from said second position to said first position, whereby to promote effective severance of a discharged bead of the product from that product remaining behind in the spout.

6. A dispenser as claimed in claim 5, wherein said unit has a leg projecting therefrom, said spout having a fulcrum pin pivotally engaged by said leg intermediate the opposite ends thereof, said container having a first stationary surface in spaced opposition to said fulcrum pin and cooperating with the latter to pivotally capture said leg therebetween during initial lost-motion movement of the unit to open said valve portion, said container further having a second surface spaced from said fulcrum pin and disposed for fulcruming engagement with the outer end of said leg during continued movement of the unit following said lost-motion opening of the valve portion as the leg is rocked way from said first surface.

7. In a dispenser for viscous products having an outlet in the outwardly facing end surface of a product discharge spout controlled by an external valve which opens and closes the outlet, said valve being disposed at one end of and movable with an actuating lever which is coupled with means for forcibly discharging product out of the spout when the lever is depressed, the improvement comprising:

means mounting the valve for transverse shearing movement of the latter entirely across the outlet and into closed, covering relationship with said end surface of the spout during return of the valve with the lever at the conculsion of product discharge whereby to promote severance of a dispensed bead of product from that remaining in the spout, said valve having a leading, product severing edge retracted out of engagement with and completely uncovering the end surface of the spout when the actuating lever is fully depressed, said dispenser having its surface portions most adjacent the spout outlet spaced away from the outlet and from the valve to prevent contact between the valve and said surface portions during movement of valve toward and away from its closed position, said actuating lever being coupled with said discharging means in such a way that said valve is at least substantially uncovered from the outlet by the actuating lever before product is attempted to be discharged by said discharging means.

* * * * *